US007918544B2

(12) United States Patent
Kawaguchi et al.

(10) Patent No.: US 7,918,544 B2
(45) Date of Patent: Apr. 5, 2011

(54) INKJET HEAD

(75) Inventors: Shinichi Kawaguchi, Hachioji (JP); Hideo Watanabe, Hachioji (JP)

(73) Assignee: Konica Minolta IJ Technologies, Inc., Tokyo (JP)

( * ) Notice: Subject to any disclaimer, the term of this patent is extended or adjusted under 35 U.S.C. 154(b) by 147 days.

(21) Appl. No.: 12/437,095

(22) Filed: May 7, 2009

(65) Prior Publication Data

US 2009/0284569 A1 Nov. 19, 2009

(30) Foreign Application Priority Data

May 14, 2008 (JP) ..... 2008-127742

(51) Int. Cl.
*B41J 2/045* (2006.01)
*B41J 2/05* (2006.01)

(52) U.S. Cl. ..... 347/68; 347/58

(58) Field of Classification Search ..... 347/68, 347/69, 70–72, 50, 57, 58; 400/124.14, 124.16; 310/311, 324, 327, 365
See application file for complete search history.

(56) References Cited

U.S. PATENT DOCUMENTS

| | | | | |
|---|---|---|---|---|
| 6,568,797 | B2 | 5/2003 | Yamauchi et al. | |
| 7,364,273 | B2 * | 4/2008 | Takahashi | 347/68 |
| 2004/0130602 | A1 | 7/2004 | Watanabe | |
| 2006/0055741 | A1 | 3/2006 | Watanabe et al. | |
| 2007/0070125 | A1 * | 3/2007 | Watanabe | 347/58 |
| 2007/0182787 | A1 * | 8/2007 | Kubo et al. | 347/58 |
| 2008/0117263 | A1 | 5/2008 | Watanabe | |
| 2008/0239010 | A1 * | 10/2008 | Tomita et al. | 347/58 |
| 2009/0284571 | A1 | 11/2009 | Kawaguchi et al. | |

FOREIGN PATENT DOCUMENTS

| | | | |
|---|---|---|---|
| EP | 1 923 219 | A2 | 5/2008 |
| JP | 2004-90374 | A | 3/2004 |
| JP | 2006-82396 | A | 3/2006 |

OTHER PUBLICATIONS

Extended European Search Report dated Aug. 25, 2009 (7 pages), issued in counterpart European Application Serial No. 09159122.2.
Shinichi Kawaguchi et al, "Inkjet head", related U.S. Appl. No. 12/436,932, filed May 7, 2009.
Extended European Search Report dated Aug. 26, 2009 (7 pages), issued in a counterpart European Application of related U.S. Appl. No. 12/436,932.

* cited by examiner

*Primary Examiner* — K. Feggins
(74) *Attorney, Agent, or Firm* — Holtz, Holtz, Goodman & Chick, PC

(57) ABSTRACT

In a harmonica type head chip having a plurality of rows of channels (row A and row B), connection electrodes for row A and the connection electrodes for row B formed on the back surface of the head chip are connected to a multilayer member having an insulating layer on one surface of which are formed the lead wirings for row A and on the other surface of which are formed the lead wirings for row B, and the lead wirings for row B are made to protrude outwards more than the lead wirings for row A and drive interconnections are electrically connected to the lead wirings for row A and the lead wirings for row B.

7 Claims, 13 Drawing Sheets

INKJET HEAD

RELATED APPLICATION

This application is based on Japanese Patent Application No. 2008-127742 filed with Japanese Patent Office on May 14, 2008, the entire content of which is hereby incorporated by reference.

TECHNICAL FIELD

The present invention relates to inkjet heads, and in particular to, inkjet heads in which electrical connections can be easily made between the drive electrodes and the drive circuits of a head chip having a plurality of channel rows.

BACKGROUND

Conventionally, as head chips that deform a driving wall by applying a voltage to the drive electrode formed on the drive walls that segment channels, and that use the pressure generated at that time to eject the ink in the channel from a nozzle, the so called harmonica type head chips are known in which opening parts are provided respectively on the front surface and the back surface.

In such harmonica type head chips, the problem is how to carry out electrical connection between each drive electrode and the drive circuit.

For example, conventionally, an inkjet head has been proposed (Japanese Unexamined Patent Application Publication No. 2004-90374) in which, by providing a penetrating electrode in the cover substrate of the head chip that covers the top part of the channel, the drive electrode inside each channel is brought out to the surface of the cover substrate of the head chip, and the electrical connection between the different drive electrodes and the drive circuit is attempted to be made on the surface of this cover substrate by an FPC, etc., in which the interconnections for driving have been made.

However, providing a penetrating electrode in the cover substrate requires difficult and complicated operations such as, the operation of opening a penetrating hole in the substrate material which is made of a ceramic, etc., and the operation of embedding electrically conductive material inside the penetrating hole, etc. Because of this, an inkjet head has been proposed (Japanese Unexamined Patent Application Publication No. 2006-82396) in which the electrical connections between the different drive electrodes and the drive circuits are made by drawing out and forming, on the back surface of the head chip which is the surface on the side opposite to the surface from which the ink is ejected, connection electrodes that are electrically connected to the different drive electrodes, bonding an interconnection substrate to this back surface of the head chip, and joining an FPC on the edge part of the interconnection substrate.

Forming by drawing out from each channel the interconnection electrodes that are electrically connected to the drive electrodes on the back surface of the head chip in this manner makes it possible to draw out and form the interconnection electrodes easily and also with high accuracy compared to providing penetrating electrodes in the cover substrate, because this can be carried out using the patterning method of the common metal thin films.

However, in the case of a head chip in which higher density is aimed at by providing in parallel two or more rows of channels in a multiple channel construction, since the channel rows are close to one another, it is difficult to draw out the interconnection electrodes up to the edge part of the head chip. For example, in the case of a head chip having two rows of channels, Channel A and Channel B, there is the problem that it is difficult to draw out and form the interconnection electrodes from the channels of row B to the edge part of the head chip on the side that has to go over the channels of row A. This is because it is necessary to go over the channels of row A.

In this case, although it is possible to consider carrying out the patterning so that the interconnection electrodes of the channels of row B are passed between the different channels of row A, there is the problem that it is difficult to carry out patterning so as to pass between very narrow channels, and also, so as not to short with the interconnection electrodes inside the different channels of row A. In particular, if the channels have been placed with a high density and with very narrow pitches, the gap between two neighboring channels is extremely narrow, and it is extremely difficult to pass the interconnection electrodes of the channels of row B between the channels of row A and to bring them out up to the edge part of the head chip without the possibility of short circuits or open circuits.

In FIG. 9 of Japanese Unexamined Patent Application Publication No. 2006-82396, on both surfaces of the interconnection substrate made of a ceramic, etc., and joined to the back surface of the head chip, interconnections are formed that are electrically connected to the different interconnection electrodes formed on the back surface of the head chip, and on each surface of the edge parts of this interconnection substrate are respectively connected FPCs in which are formed the drive interconnections for applying drive signals from the drive circuits.

However, since this operation of connecting these FPCs has to be carried out by placing the head chip with interconnection substrate on a work bench, even if it is easily possible to connect the FPC from the side of the same surface as the surface of joining the head chip with the interconnection substrate, when connecting the FPC from the side opposite to this surface, there is the problem that the head chip becomes an obstruction, it is not possible to place it on the work bench in a stable manner, and the work becomes difficult.

Further, in the case of connecting FPCs respectively on both surfaces, there is the problem that the operation becomes complicated because, after an FPC is connected on one surface, it is necessary to turn the head chip with an interconnection substrate upside down.

In view of this, the purpose of the present invention is to provide an inkjet head in which it is possible to easily carry out the electrical connections of the drive interconnections in order to apply the drive voltages from the drive circuits to each of the channels of two rows that are close to each other in a honeycomb type head chip in which a plurality of rows of channels are provided, which electrical connections are made only at one edge part of the head chip, and also, only on the side of the same surface as the surface of joining with the head chip.

SUMMARY

According to one aspect of the present invention, an inkjet head comprising: a head chip comprising: a plurality of rows of channels arranged in parallel to each other, wherein each row of the plurality of rows of channels comprises a plurality of channels arranged in parallel to each other, and each of the plurality of channels is provided with an opening on a front surface of the head chip, from which side ink is ejected from the head chip, and an opening on a back surface of the head chip opposite to the front surface; a plurality of driving walls each made of piezoelectric member, wherein each of the plurality of driving walls and each of the plurality of channels are provided alternately; and a plurality of drive electrodes provided in each of the plurality of channels; wherein, when assuming that one of the plurality of rows of channels provided on a side of an end of the head chip is row A and another of the plurality of rows of channels provided next to row A is row B, on the back surface of the head chip, a plurality of interconnection electrodes for row A that conduct electrically to the plurality of drive electrodes are formed extending from each of the plurality of channels of row A to the end of the head chip and a plurality of interconnection electrodes for row B that conduct electrically to the plurality of drive electrodes are formed extending from each of the plurality of channels of row B to short of the row A; a nozzle plate comprising a plurality of nozzles; a multi layer member comprising: an insulating layer; a lead wiring for row A provided on one surface of the insulating layer; and a lead wiring for row B provided on the other surface of the insulating layer; wherein the one surface of the insulating layer faces the back surface of the head chip, the lead wiring for row A is connected so as to conduct electrically to one of the plurality of interconnection electrodes for row A and the lead wiring for row B is connected so as to conduct electrically to the one of the plurality of interconnection electrodes for row B; wherein an end portion of the multilayer member protrudes beyond the end of the head chip on the row A side of the head chip; and wherein, at an end portion of the multilayer member, the lead wiring for row B extends beyond an end portion of the insulating layer over the lead wiring for row A outward; and a plurality of drive interconnections for applying drive signals from a drive circuit to the lead wiring for row A and the lead wiring for row B from a side of a surface of joining the multilayer member with the head chip.

DETAILED DESCRIPTION OF THE PREFERRED EMBODIMENTS

The different preferred embodiments of the present invention are described below with reference to the figures.

First Preferred Embodiment

Figure 1:
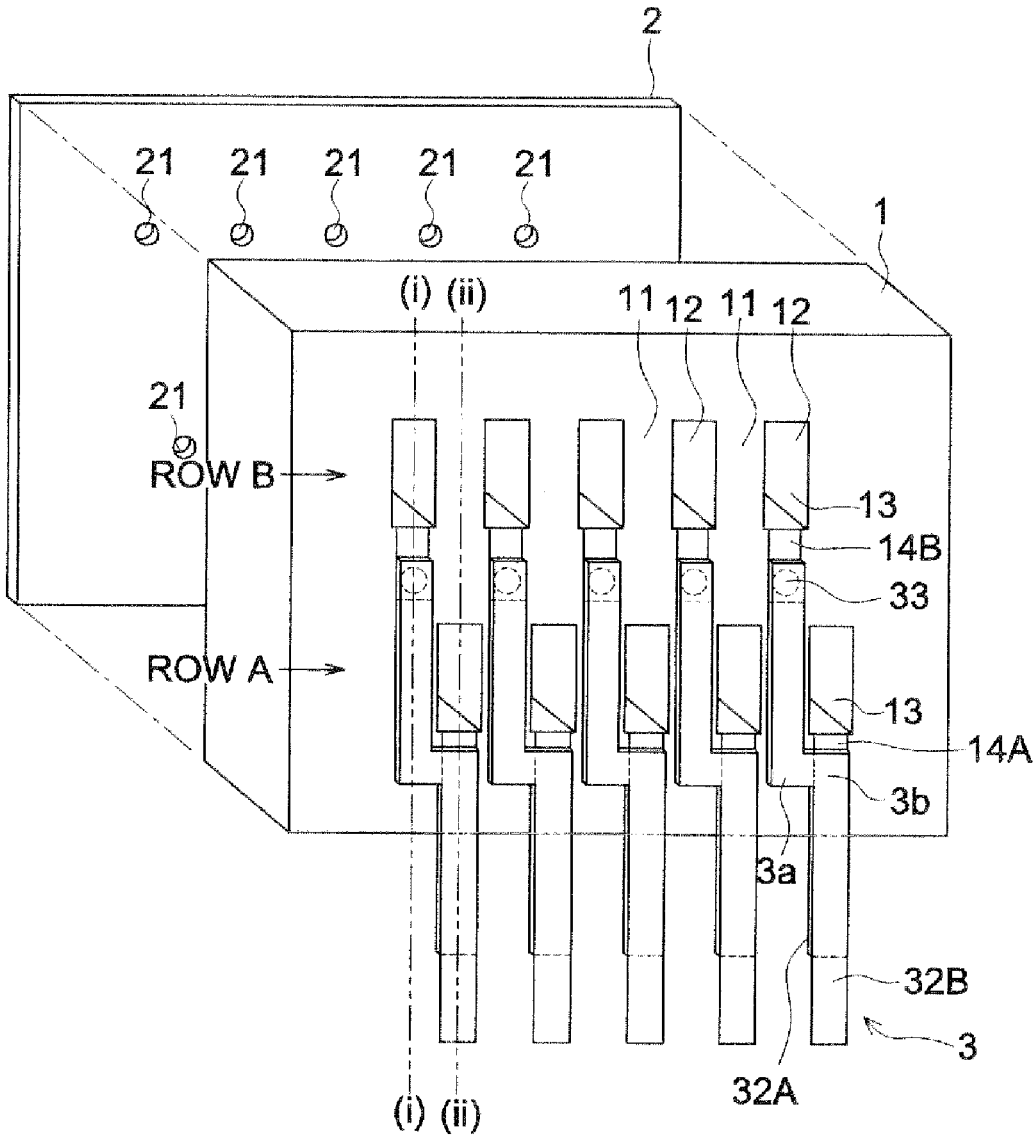
FIG. 1 is a perspective view diagram of an inkjet head according to a first preferred embodiment as seen from the side of the back surface.
Figure 2B:
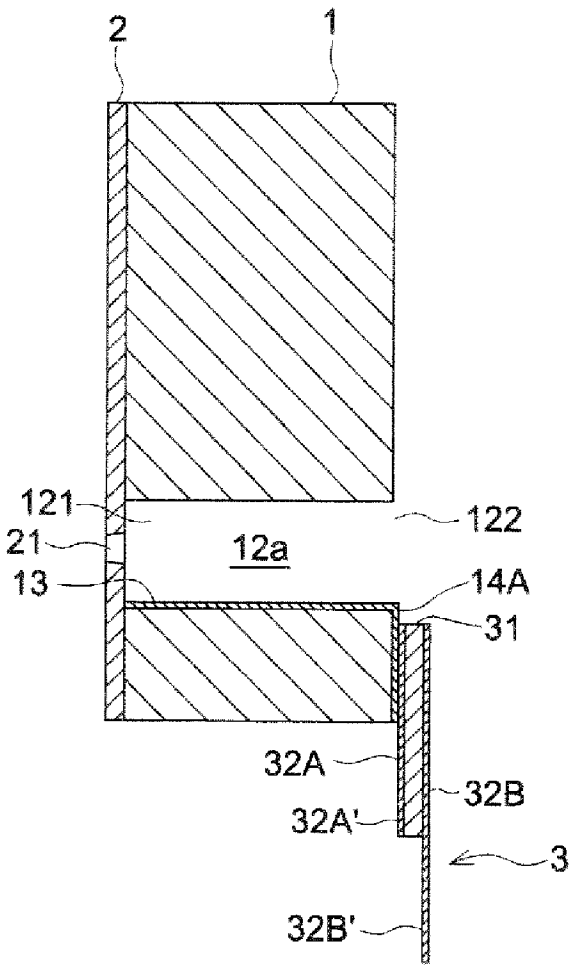
FIG. 2*b* is a cross sectional view diagram at (ii)-(ii) of FIG. 1.
Figure 2A:
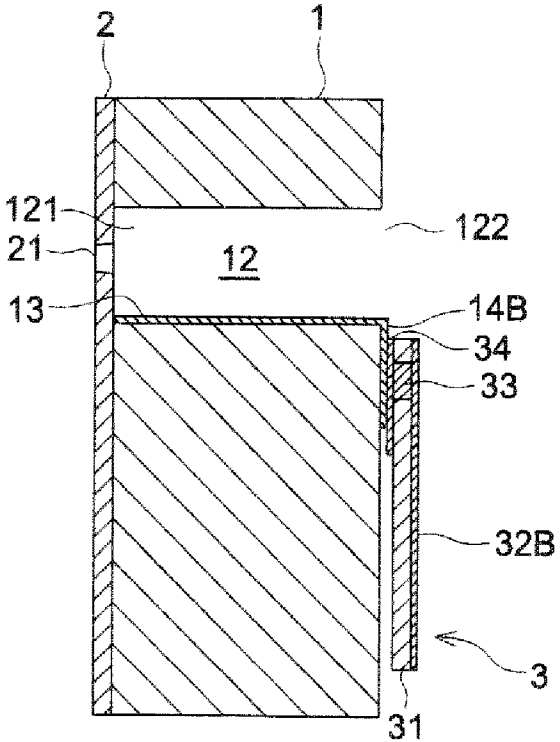
FIG. 2*a* is a cross sectional view diagram at (i)-(i) of FIG. 1.

FIG. 1 is a perspective view diagram of an inkjet head according to a first preferred embodiment as seen from the side of the back surface, FIG. 2*a* is a cross sectional view diagram at (i)-(i) of FIG. 1, and FIG. 2*b* is a cross sectional view diagram at (ii)-(ii) of FIG. 1. Further, in the cross sectional diagrams, the layer of the adhesive has not been shown in the figures.

In the figures, 1 is a head chip, 2 is a nozzle plate bonded on to the front surface of the head chip 1, and 21 are the nozzles formed in the nozzle plate 2.

Further, in the present patent specification, the surface on the side from which ink is ejected from the head chip is referred to as the "front surface" and the surface opposite to that is referred to as the "back surface". In addition, the outside surfaces that are positioned at the top and the bottom in the figures enclosing the channels placed in parallel in the head chip are respectively referred to as the "top surface" and the "bottom surface".

In the head chip 1, two parallel rows of channels at the top and bottom in the figure are provided with drive walls 11 made of a piezoelectric device and channels 12 alternately provided and in parallel in a row of channels. The number of channels in a row of channels is not particularly restricted.

Here, the row of channels positioned on the lower side in the figure is taken as row A and the row of channels positioned on the upper side in the figure is taken as row B.

In the present preferred embodiment, it is considered that all the channels in each row of channels is an ejecting channel from which ink is ejected, and each of the channels 12 of row A and the channels 12 of row B have been arranged shifted mutually by half a pitch. In other words, when the head chip 1 is set in the up-down direction in the figure, the placement relationship is such that the channels 12 of row A and the channels 12 of row B are not in a single line, but the gaps between the channels 12 of row A and the channels of row B, or the gaps between the channels 12 of row B and the channels of row A are in line.

The shape of each channel 12 is such that, the walls on both sides extend almost perpendicularly to the top surface and the bottom surface of the head chip 1, and are also mutually parallel. On the front surface and the back surface of the head chip 1, the opening parts 121 at the front surface and the opening parts 122 at the back surface of the respective channels 12 are opposite to each other. Each of the channels 12 is of the straight type in which the size and shape along the longitudinal direction extending from the opening part 122 at the back surface to the opening part 121 at the front surface are almost unchanged.

The entire internal surface of each of the channels 12 is formed to be in close contact the drive electrodes respectively made of a metal film such as of Ni, Au, Cu, Al, etc.

Further, at the back surface of the head chip 1, not only the interconnection electrodes 14A for row A that connect electrically to the drive electrodes 13 inside each of the channels 12 of row A are formed in parallel so that they are drawn out with the same pitch as the channels 12 of row A from the channel 12 towards the edge part of the head chip 1 in the downward direction in the figure among the directions that are at right angles to the row of channels (the up and down directions in the figure), but also the interconnection electrodes 14B for row B that connect electrically to the drive electrodes 13 inside each of the channels 12 of row B are formed in parallel so that they are drawn out with the same pitch as the channels 12 of row B from the channel 12 towards the row A of channels and up to just before the row A.

In this manner, although the interconnection electrodes 14A for row A are arranged in parallel at one edge side at the back surface of the head chip 1 (here, the bottom edge part side in the figure), since the interconnection electrodes 14B for row B are formed so that they are drawn out from each of the channels 12 of row B in the same direction as the interconnection electrodes 14A for row A, in order to simplify the connection with drive circuits as described later, it is necessary to make it easy to connect even these interconnection electrodes 14B for row B at one edge part side (here, the bottom edge part side in the figure) of the head chip 1 using an FPC, etc., similar to the interconnection electrodes 14A for row A.

Because of this, in the present invention, the interconnections that are in electrical contact with the interconnection electrodes 14A for row A and the interconnection electrodes 14B for row B are being drawn out so that each of them protrudes by a large distance towards the outside beyond one edge part side (here, the bottom edge part side in the figure) of the head chip 1 using a multilayer member 3 which comprises lead wirings 32A for row A and lead wirings 32B for row B.

The multilayer member 3, is formed here to correspond individually to one channel 12 of row A and one channel 12 of row B. In each multilayer member 3, the lead wiring 32A for row A and the lead wiring 32B for row B, etc., are formed on both surfaces of an insulating layer 31. In other words, each multilayer member 3 has the lead wiring 32A for row A corresponding to the interconnection electrode 14A for row A of one channel 12 of row A on one of its surfaces, and on its other surface, it has the lead wiring 32B for row B corresponding to the interconnection electrode 14B for row B of one channel 12 of row B.

Since each of the channels 12 of row A and each of the channels 12 of row B are mutually shifted from each other by half a pitch, each multilayer member 3 passes from the position corresponding to an interconnection electrode 14B for row B in between the channels 12 of row A and towards a position corresponding to the interconnection electrode 14A for row A, and is bent in the form of a crank by the right angle bend sections 3*a* and 3*b* at two locations. Therefore, the lead wiring 32A for row A and the lead wiring 32B for row B are made parallel to each other so that they overlap each other at the same position on both surfaces of the insulating layer 31 in a position corresponding to the interconnection electrode 14A for row A (the region that overlaps the interconnection electrode 14A for row A).

The lead wiring 32A for row A, in one surface of the insulating layer 31, is formed only at a position in the head chip 1 corresponding to the interconnection electrode 14A for row A. On the other hand, the lead wiring 32B for row B is formed over the entire surface on the other surface of the insulating layer 31. In the proximity of the edge part on the row B side of the insulating layer 31, in the region in which the lead wiring 32B for row B overlaps the interconnection electrode 14B for row B, a penetrating electrode 33 is formed that penetrates through that insulating layer 31. Because of this penetrating electrode 33, in each multilayer member 3, electrical connection becomes possible between the lead wiring 32B for row B formed on the surface opposite to the surface of joining with the head chip 1 and the interconnection electrode 14B for row B of the head chip 1.

Further, the symbol 34 in FIG. 2*a* is a multilayer electrode formed in a multilayer structure at a position corresponding to the interconnection electrode 14B for row B of the head chip 1 in the multilayer member 3 at the surface of joining with the head chip 1, and is electrically connected only with the penetrating electrode 33 so that it is not connected to the lead wiring 32A for row A. By forming this multilayer electrode 34 with the same thickness as that of the lead wiring 32A for row A, it is not only possible to make uniform the maximum height of protrusion of the surface of joining with the head chip 1, but also makes it possible to obtain definite electrical connection with the interconnection electrode 14B for row B.

The edge part on the bottom side in the figure of each multilayer member 3 protrudes in the outward direction beyond the edge part on the row A side of the head chip 1 and projects by a large distance. This projecting part becomes the part for connection with the drive interconnections for applying the drive signal from the drive circuit described later.

In the part in which this multilayer member 3 protrudes by a large distance beyond the edge part of the head chip 1, the lead wiring 32A for row A is exposed for a prescribed length on the side of the surface that is joined to the head chip 1 and becomes the connection part 32A' with the drive interconnection. Further, the lower side edge part of the insulating layer 31 of the multilayer member 3 is up to the edge part of the lead wiring 32A for row A, and the edge part of the lead wiring 32B for row B protrudes outward beyond the lower side edge part in the figure of this insulating layer 31 and protrudes further outward than said lead wiring 32A for row A. Because of this, the edge part of the lead wiring 32B for row B is exposed by a prescribed length similar to the lead wiring 32A for row A towards the same surface as the joint with the head chip 1, and this exposed surface is taken to be the connection part 32B' with the drive interconnections.

This multilayer member 3 makes the respective lead wirings 32A become electrically connected with the interconnection electrodes 14A for row A, makes the multilayer electrode 34, which is electrically connected with the lead wirings 32B for row B via the penetrating electrode 33, become electrically connected with the interconnection electrodes 14B for row B, and is joined to the head chip 1 at its back surface. At this time, the lead wiring 32B for row B is not electrically connected to anything other than the interconnection electrodes 14B for row B at the back surface of the head chip 1 because it has been formed on the side of the insulating layer 31 that is opposite the surface on which the lead wirings 32A for row A have been formed, and hence there is no possibility of any short circuits.

Next, examples of manufacturing these kinds of inkjet heads are explained below based on FIGS. 3*a* to 9.

Figure 3A:
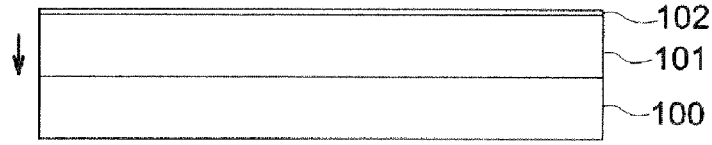
FIG. 3*a* to FIG. 3*e* are diagrams explaining examples of manufacturing an inkjet head.

To begin with, on one substrate 100, a piezoelectric device substrate 101 such as PZT, etc., that has been subjected to polarization treatment (the orientation of polarization is indicated by an arrow mark in the figures) is bonded using an epoxy type adhesive, and in addition, a dry film 102 is pasted on the surface of this piezoelectric device substrate 101 (FIG. 3*a*).

Figure 3B:
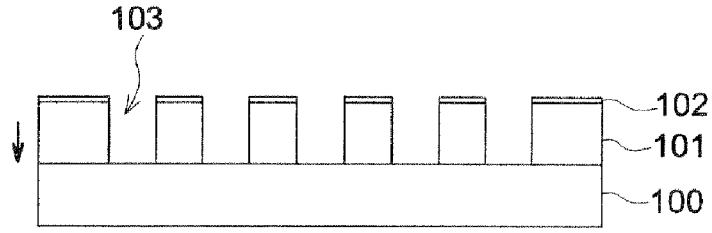

Next, from the side of this dry film 102, a plurality of parallel groves 103 are cut by grinding using a dicing blade, etc. By grinding and cutting each groove 103 so that it extends from one edge part of the piezoelectric device substrate 101 to the other edge part, and also, by grinding for a fixed depth so that the groove extends almost up to the substrate 100, a straight shape is formed whose size and shape are almost unchanged in the longitudinal direction (FIG. 3*b*).

Figure 3C:
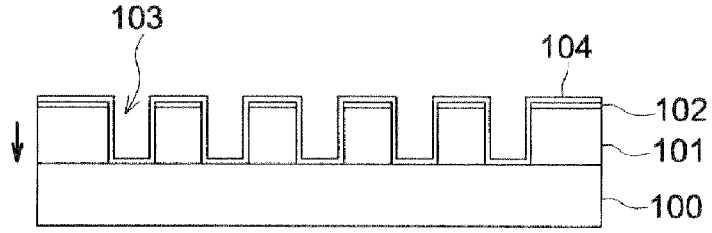

Next, from the side in which the grooves 103 are cut by grinding, a metal film 104 is formed on the top surface of the dry film 102 remaining after cutting by grinding and on the inside surface of each of the grooves 103 using a metal for electrode formation such as Ni, Au, Cu, Al, etc., adopting a method such as the sputtering method, vacuum evaporation method, etc. (FIG. 3*c*).

Figure 3D:
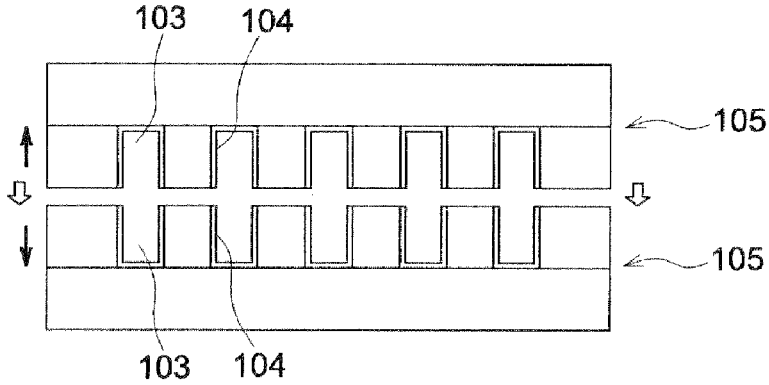

After that, by removing the dry film 102 along with the metal film 104 formed on its surface, a substrate 105 is obtained with a metal film 104 formed only on the inside surface of each of the grooves 103. Further, two of the substrates 105 formed in a similar manner are taken, their positions are adjusted so that the grooves 103 on each of the substrates are matched with each other, and the two substrates are bonded together using an epoxy type adhesive material, etc. (FIG. 3*d*).

Figure 3E:
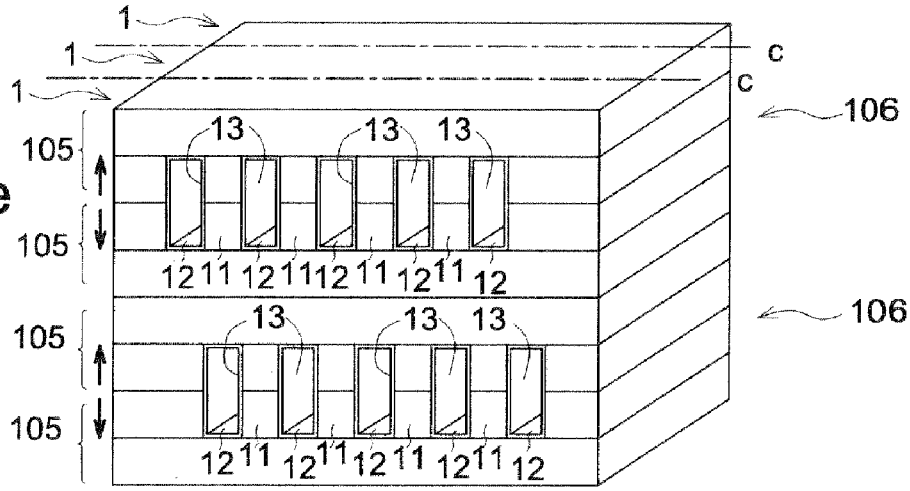

Subsequently, two of the head substrates 106 obtained in this manner are taken, they are placed one on top of the other and bonded after adjusting their positions so that the channels of the two head substrates 106 are shifted from each other by half a pitch, and by cutting in a direction at right angles to the longitudinal direction of the grooves 103, a plurality of pieces of the head chip 1 of the harmonica type having two rows of channels are prepared at once. Each of the grooves 103 becomes a channel 12, and the metal thin film inside each groove 103 becomes the drive electrode 12, and the part between two neighboring grooves 103 becomes the drive wall 11. The width between the cutting lines C and C determines the drive length (length L) of the channels 12 the head chips 1, 1, . . . , prepared by them, and are appropriately determined according to this drive length (FIG. 3*e*).

Figure 4:
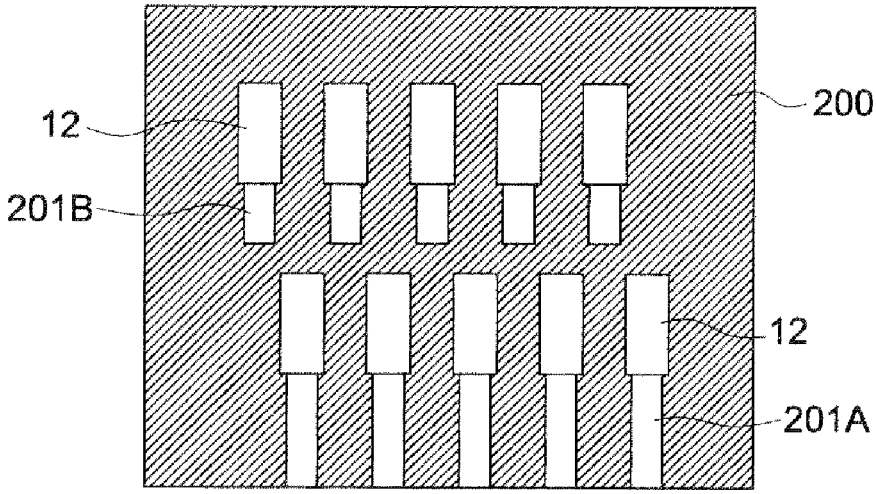
FIG. 4 is a diagram explaining an example of manufacturing an inkjet head.

Next, a dry film 200 is adhered to the back surface of the head chip 1 obtained in this manner, and the opening part 201A for forming the interconnection electrodes 14A for row A and the opening part 201B for forming the interconnection electrodes 14B for row B are formed by exposure and developing (FIG. 4).

Further, from the side of this dry film 200, for example, Al is used as the metal for forming electrodes using the vacuum evaporation method, and an Al thin film is formed selectively and respectively inside each of the openings 201A and 201B. Because of this Al film, the interconnection electrodes 14A for row A and the interconnection electrodes 14B for row B are formed on the back surface of the head chip 1.

In order to make definite the connection with the drive electrodes 13 inside each of the channels 12, it is desirable that the vacuum evaporation is done twice by changing the orientation. In concrete terms, from a direction perpendicular to the surface shown in the figure, it is desirable to carry out from directions of 30 degrees to the top and bottom. In addition, as is shown in FIG. 3*d*, in order to make definite the electrical connection between the metal films 104 that are separated into top and bottom ones, it is desirable to carry out vacuum evaporation from a direction at an angle of 30 degrees to the right or left.

Figure 5:
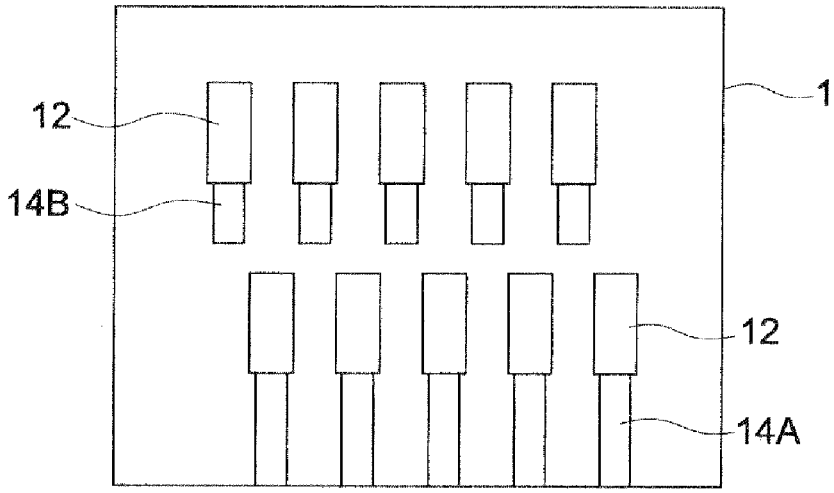
FIG. 5 is a diagram explaining an example of manufacturing an inkjet head.

Further, the method of forming the Al films need not be restricted to vacuum evaporation, but it is possible to use an ordinary thin film forming method. In addition, it is also possible to use the method of coating a conductive paste by an inkjet. In particular, the sputtering method is ideally suitable because it is possible to form the metal film up to the inside of the channel even without particularly changing the direction since the directions of the flying metal particles is random. After forming the Al film, by dissolving and peeling off the dry film 200 using a solvent, the Al film formed on the dry film 200 is removed, and on the back surface of the head chip 1, only the interconnection electrodes 14A for row A and the interconnection electrodes 14B for row B will remain (FIG. 5).

Further, considering the ease of operation in the developing process and water washing process of the dry film 200, it is desirable that the dry film 200 has an opening over the entire surface of the channel 12. By being open over the entire surface of the channel 12, it becomes easy to remove the developing liquid and cleaning water inside the channels 12.

On the other hand, in order to form the multilayer member 3, on both sides of the organic film that becomes the insulating layer 31, penetrating electrodes 33 are formed in advance for providing electrical connection between the lead wirings 32A for row A, lead wirings 32B for row B, and the multilayer electrodes 34, and between the lead wirings 32B for row B and the multilayer electrodes 34.

Figure 6:
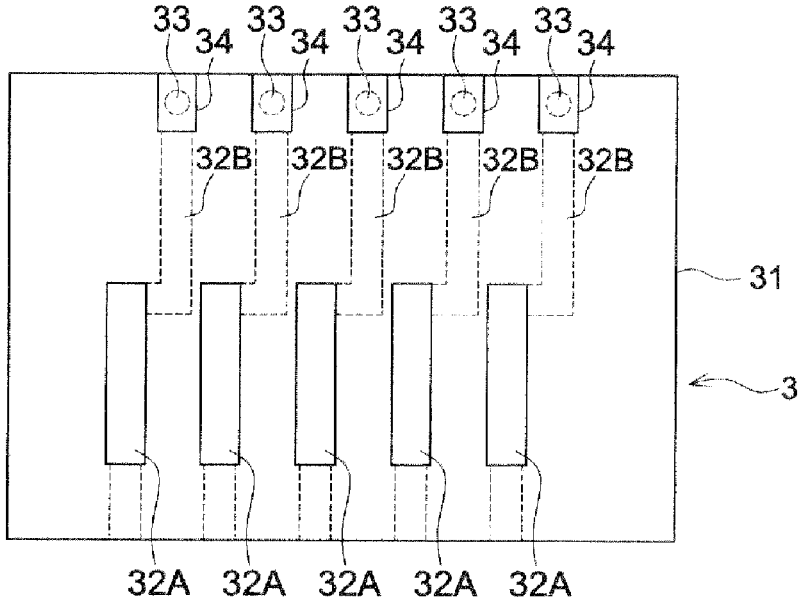
FIG. 6 is a diagram explaining an example of manufacturing an inkjet head.
Figure 7:
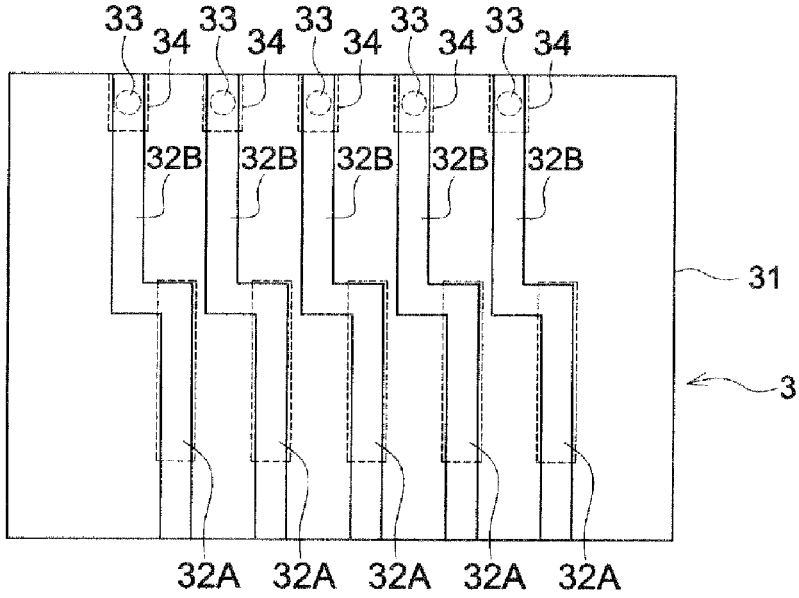
FIG. 7 is a diagram explaining an example of manufacturing an inkjet head.

FIG. 6 is a plane view diagram as viewed from the side of the surface of joining the multilayer member 3 with the head chip 1 with the large size before adhering to the head chip 1, and FIG. 7 is a plane view diagram as seen from the side of the surface opposite to the surface of bonding with the head chip 1.

In the multilayer member 3 before bonding with the back surface of the head chip 1, the lead wirings 32A for row A, the lead wirings 32B for row B, the penetrating electrodes 33, and the multilayer electrodes 34 are formed in advance on each surface of the large sized insulating layer 31.

Here, it is desirable to use an organic film for the insulating layer 31. As an organic film, it is desirable that it is an organic film that can be patterned by ordinary dry etching, and for example, it can be a film made of various types of plastics such as polyimide, liquid crystal polymer, aramid, polyethylene terephthalate, etc. Among them, polyimide film which has good etching characteristics is desirable. Further, in order to make dry etching easy, although it is desirable to use as thin a film as possible, it is also desirable to use an aramid film which has high strength and can retain its strength even when it is thin.

Further, as an insulating layer 31 that can be dry etched, it is also possible to use a silicon substrate. However, for the dry etching of silicon, generally the cost becomes high because it is necessary to use special gases such as $CF_4$ or $SF_6$, etc., and even the apparatus becomes special.

From the point of view of acquiring strength and ease of dry etching, it is desirable that the thickness of the insulating layer 31 is 3 to 100 μm.

The lead wirings 32A for row A and the lead wirings 32B for row B formed on both surfaces of this insulating layer 31 also function as the masking materials during the dry etching process. Although it is possible to consider Al, Cu, Ni, W, Ti, Au, etc., as the metals that can be used for each of these lead wirings 32A and 32B, among these, Cu is desirable because it is inexpensive and even patterning is also easy, and it is possible to form the Cu film by sputtering and to form the different lead wirings 32A and 32B and electrodes 34 by an ordinary thin film patterning technology.

From the point of view of resistance to dry etching and ease of patterning, it is desirable that the thickness of each of these lead wirings 32A and 32B and electrodes 34 is 0.1 to 50 μm.

As the method of forming the penetrating electrodes 33, for example, it is possible to form penetrating holes in advance in the insulating layer 31 by laser drilling, and to electroplate the inside of the penetrating holes to form plated-through holes.

Here, as the insulating layer 31, Cu was formed with a thickness of 5 μm using sputtering equipment on both surfaces of a polyimide film with a thickness of 25 μm in which the penetrating electrodes 33 had been formed in advance.

As is shown in FIG. 6 and FIG. 7, while the lead wirings 32B for row B are formed by bending in the shape of a crank and their bottom edge part extends up to the bottom edge part of the insulating layer 31, the lead wirings 32A for row A are up to just before the bottom edge part of the insulating layer 31.

Figure 8A:
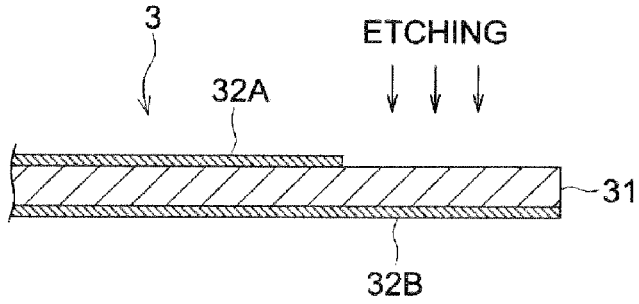
FIG. 8*a* and FIG. 8*b* are diagrams explaining examples of manufacturing an inkjet head.

Here, as is shown in FIG. 8*a*, in the neighborhood of the bottom edge part of this insulating layer 31, dry etching is carried out from the surface of forming the lead wirings 32A for row A, and the unnecessary insulating layer 31 that is exposed towards the bottom edge part side of the lead wirings 32A for row A is removed.

Figure 8B:
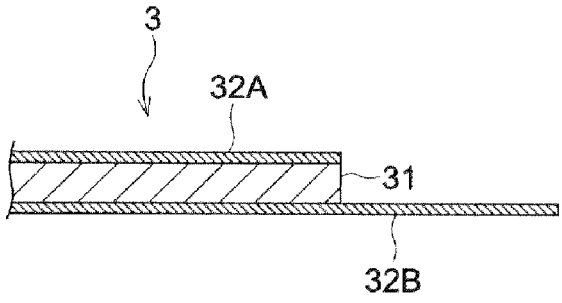

As a concrete method of dry etching, it is possible to select appropriately according to the plastic that is used for the insulating layer 31. For example, if a polyimide film is used, it is possible to carry out dry etching using oxygen plasma. At this time, since the lead wirings 32A for row A on the front surface and the lead wirings 32B for row B on the back surface are not dissociated by oxygen plasma, as is shown in FIG. 8*b*, the lead wirings 32A for row A become a mask, the insulating layer 31 under them does not get etched but remains as it is, and also, the insulating layer above the lead wirings 32B for row B is removed and those lead wirings 32B for row B get exposed as they are. Further, at this time, even the surface of the insulating layer 31 that is not to be etched is masked appropriately at the parts other than the parts that are to be etched to expose the lead wirings 32B for row B.

Figure 9:
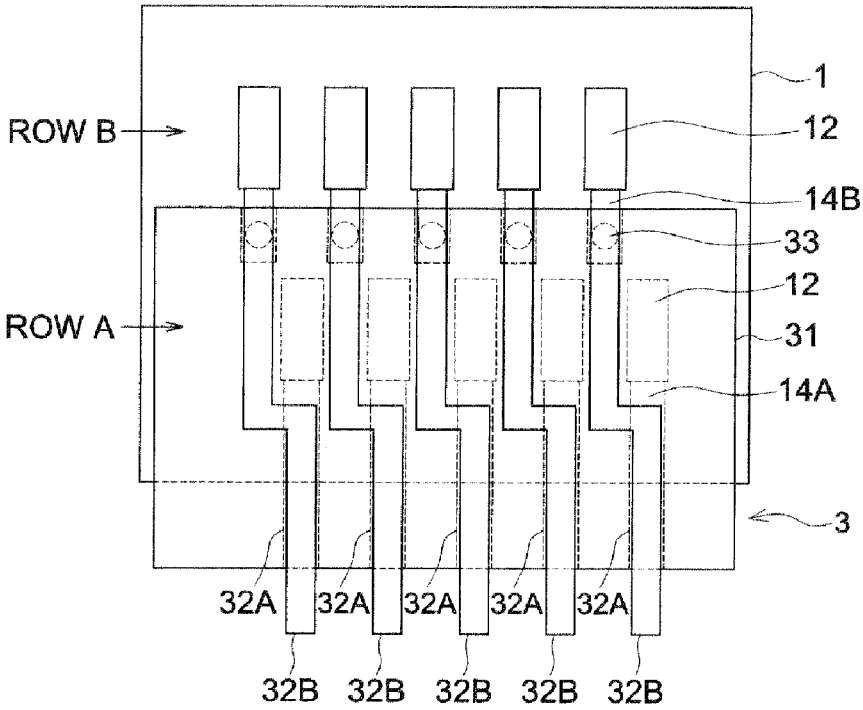
FIG. 9 is a diagram explaining an example of manufacturing an inkjet head.

Next, this large size multilayer member 3 formed in this manner is positioned so that the surface on which the lead wirings 32A for row A and the multilayer electrodes 34 are formed is in contact with the back surface of the head chip 1, and also, each lead wiring 32A for row A and the corresponding interconnection electrode 14A for row A are electrically connected, and each multilayer electrode 34 is electrically connected with the corresponding interconnection electrode 14B for row B, and the two are bonded together using an adhesive material (FIG. 9).

Here, an epoxy type adhesive material (Epotech 353ND manufactured by Epoxy Technologies Inc.) was used as the adhesive material, and the hardening conditions were 100° C. for 30 minutes and the pressure was 10 kg/cm$^2$.

The electrical conduction between the lead wirings 32A for row A and the interconnection electrodes 14A for row A, and the electrical conduction between the multilayer electrodes 34 and the interconnection electrodes 14B for row B at the time of bonding the multilayer member 3 are carried out using the NCP (Non Conductive Paste) method in which the electrical connection is achieved by pressure bonding metal films together using an adhesive. In this case, the epoxy type adhesive material not only functions as the adhesive material for the multilayer member 3, but also functions as an NCP. In the case of the NCP method, since it is sometimes difficult to obtain the electrical connection if the surface of the metal film is oxidized, it is desirable that the surfaces of the interconnection electrodes 14A for row A and the interconnection electrodes 14B for row B are some metal such as Au, Pt, etc., that are difficult to oxidize, and this can be realized by making the metal film have multiple layers.

Further, it is also possible to use the ACP (Anisotropic Conductive Paste) method of using an adhesive material in which metal particles have been dispersed. In this case, since the metal particles penetrate the oxide films on the metal films and get connected, it is easily possible to obtain definite electrical connection even if the interconnection electrodes 14A for row A and the interconnection electrodes 14B for row B are some metal such as Al whose surface is prone to oxidization.

In particular, in the present invention, obtaining electrical conduction between the interconnection electrodes 14B for row B and the lead wirings 32B for row B of the multilayer member 3 by forming penetrating electrodes 33 in the insulating layer 31, and using an adhesive material having metal particles (electrically conductive particles) is most desirable for aiming to obtain definite electrical connection between the two.

Figure 10A:
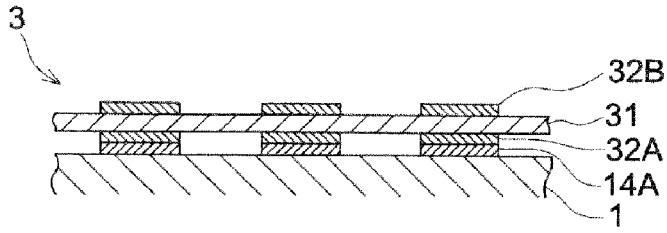
FIG. 10*a* is a cross sectional view diagram showing the condition of the joining part between the interconnection electrodes for row A and the multilayer member of a head chip.
Figure 10B:
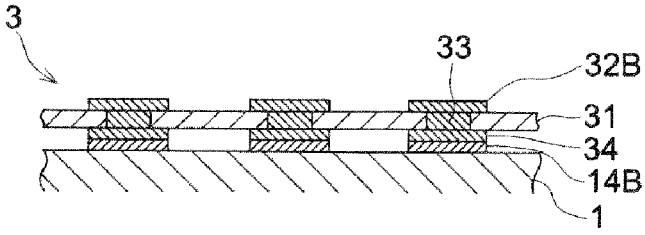
FIG. 10*b* is a cross sectional view diagram showing the condition of the joining part between the interconnection electrodes for row B and the multilayer member of a head chip.

Further, in the multilayer member 3, at the position of joining with the interconnection electrodes 14A for row A of the head chip 1 shown in FIG. 10*a*, at the same position as that of the lead wirings 32A for row A that are electrically connected to the interconnection electrodes 14A for row A, since the lead wirings 32B for row B are formed with the insulating layer 31 in between them, and also since, at the position of joining with the interconnection electrodes 14B for row B of the head chip shown in FIG. 10*b*, at the same position as that of the multilayer electrodes 34 that are electrically connected to the interconnection electrodes 14B for row B, since the lead wirings 32B for row B are formed within the insulating layer 31 in between them, the height of the part where the pressure force acts during joining becomes uniform, it is possible to apply the pressure force uniformly to the connection parts, and it is possible to increase the definiteness of the electrical connections.

Further, in addition to the method of bonding to the back surface of the head chip 1 the multilayer member 3 after patterning the lead wirings 32B for row B in the insulating layer 31 in this manner, it is also possible to carry out patterning by etching the lead wirings 32*b* for row B by etching after bonding to the back surface of the head chip 1 the multilayer member 3 before patterning in which a film of a metal such as Cu, etc., has been formed on the entire surface of the surface that is opposite to the surface that is bonded to the head chip 1. Even in this case, the penetrating electrodes 33 are formed in advance.

In this case, although the pattern is transferred using a photo mask, the position adjustment of the photo mask relative to the head chip 1 is carried out using an exposure apparatus, it is possible to carry out position adjustment to a position accuracy of several μm, and it is possible to obtain high accuracy that cannot be obtained with other methods. In addition, according to this method, because of the presence of a metal film that is formed on the entire surface, even if expansion occurs in the insulating layer 31 due to the application of heat and pressure during bonding the multilayer member 3, since the patterning of the lead wirings 32B for row B is made thereafter at the prescribed positions, there is the advantage that there is no possibility of any position shift occurring with respect to each of the channels 12 of row B or with the connection electrodes 14B or row B.

Next, dry etching is done on the multilayer member 3 from the back surface of the head chip 1, and the unnecessary insulating layer 31 is further removed to separate the different multilayer members 3. A concrete method of dry etching is as has already been described above.

Further, although wet etching can also be used as the etching method, dry etching is desirable since normally the wet etching liquid is acidic or basic and is likely to corrode the drive electrodes 13. Furthermore, in a case even when some oozing out of the adhesive material is present at the time of bonding the insulating layer 31, since it is possible to dissociate and remove unnecessary adhesive material simultaneously at the time of dry etching, the problem of excess adhesive material clogging the channels or covering the surfaces of electrodes is solved.

In addition, since the insulating layer 31 is removed entirely except at the parts where it is masked by the lead wirings 32B for row B, at the stage of bonding to the back surface of the head chip 1, it is also possible to make the shape of the insulating layer 31 larger than the back surface of the head chip 1, and in this case, it is possible to carry out the bonding operation with the insulating layer 31 protruding outwards beyond the head chip 1, there is the advantage that the ease of operation is far superior.

Further, the method of dry etching need not be restricted to the above method, but can be selected appropriately.

Because of this, on the back surface of the head chip 1, the multilayer members 3, which are made of the insulating layer 31 remaining after dry etching, the lead wirings 32A for row A, the lead wirings 32B for row B, penetrating electrodes 33, and multilayer electrodes 34, are placed independently, and as is shown in FIG. 1, FIG. 2*a*, and FIG. 2*b*, the lead wirings 32A for row A and the lead wirings 32B for row B will both be in a condition in which they are both drawn out projecting by a large distance to the outside from the edge part of the head chip 1 shown in the lower part in the figure.

Further, in FIG. 4, FIG. 5, and FIG. 9, the drive electrodes 13 have not been shown in the figure.

Figure 11:
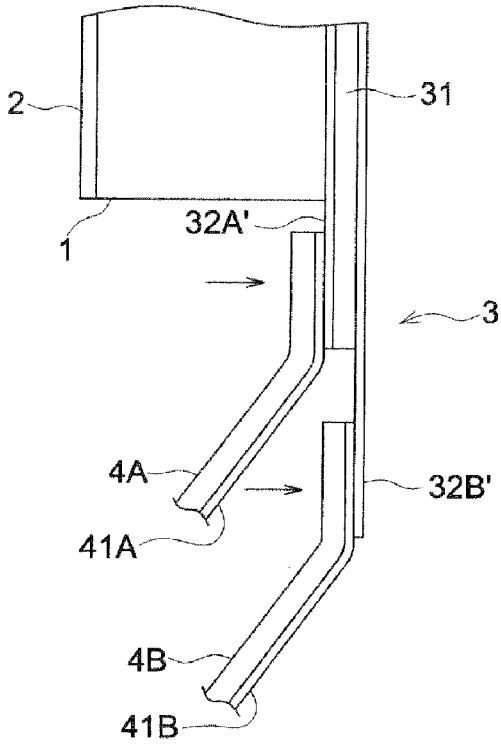
FIG. 11 is a diagram explaining an example of manufacturing an inkjet head.

After this, as is shown in FIG. 11, to begin with, the drive interconnections 41B formed in the FPC 4B for applying the drive signals from the drive circuits are connected electrically to the connection parts 32B' of the lead wirings 32B for row B of the multilayer member 3 that is protruding outwards by a large distance from the edge part of the head chip 1, and next, the drive interconnections 41A formed in the FPC 4A for applying the drive signals from the drive circuits are successively connected electrically to the connection parts 32A' of the lead wirings 32A for row A.

These operations of connecting to FPC 4A and 4B are possible by merely carrying out at one edge part of the head chip 1 (individually, the lower edge part shown in the figure). In addition, in the condition in which the surface of the multilayer member 3 that is opposite to the surface which is joined to the head chip 1 is placed on a work bench, etc., since it is possible to carry out both of them with each of the connection parts 32A' and 32B' of the multilayer member 3 from one direction on the side of the same surface as the surface of joining with the head chip 1, the ease of operation becomes far superior.

After that, an ink manifold (not shown in the figure) similar to a conventional one that forms an ink tank for supplying ink to inside each of the channels 12 is joined to the back surface of the head chip 1.

However, in the head chip 1, since the drive electrodes 13 inside the channels 12 come into direct contact with the ink, in case water based inks are use, a protective film becomes necessary on the surfaces of the drive electrodes 13. Further, since even the lead wirings 32B for row B of the multilayer member 3 come into direct contact with the ink, in case solvent based inks are used, protective films become necessary for protecting these from solvents. In view of this, after joining the multilayer member 3 to the back surface of the head chip 1, it is desirable to form a protective film on all the surfaces of the head chip 1, that is, on the surfaces of each of the drive electrodes 13 and on the surfaces of the multilayer member 3.

As a protective film, it is desirable to carry out coating using a film made of para-xylylene and its derivatives (hereinafter referred to as parylene films). Parylene films are plastic coatings made of plastics of poly-para-xylylene dimer and/or its derivatives, and are formed by the CVD (Chemical Vapor Deposition) method using a solid para-xylylene dimer or its derivatives as the evaporation source. In other words, para-xylylene radicals generated by the evaporation and thermal dissociation of para-xylylene dimer adhere to the surface of the head chip 1 and carry out polymerization reaction to form a covering film.

There are various types of parylene films, and depending on the necessary performance, it is possible to use as the desired parylene film different types of parylene films or a parylene film with a multiple layer structure in which a plurality of layers of different types of parylene films are superimposed on one another.

It is desirable to make the film thickness of such a parylene film from 1 μm to 10 μm.

Since parylene films can penetrate even very fine regions and form coating films, by forming the coating film on the head chip 1 before joining the nozzle plate 2, not only the drive electrodes 13 but also the multilayer member 2 gets covered with the parylene film and is protected from the ink.

In the case that a parylene film is formed in this manner, the nozzle plate 2 is joined thereafter. Further, if the parylene film is formed before connecting FPC 4A and 4B, a suitable protective tape that can be peeled off should be affixed to the parts 32A' and 32B' of connection with FPC 4A and 4B in the multilayer member 3 so that the parylene film is not formed there.

Second Preferred Embodiment

Figure 12:
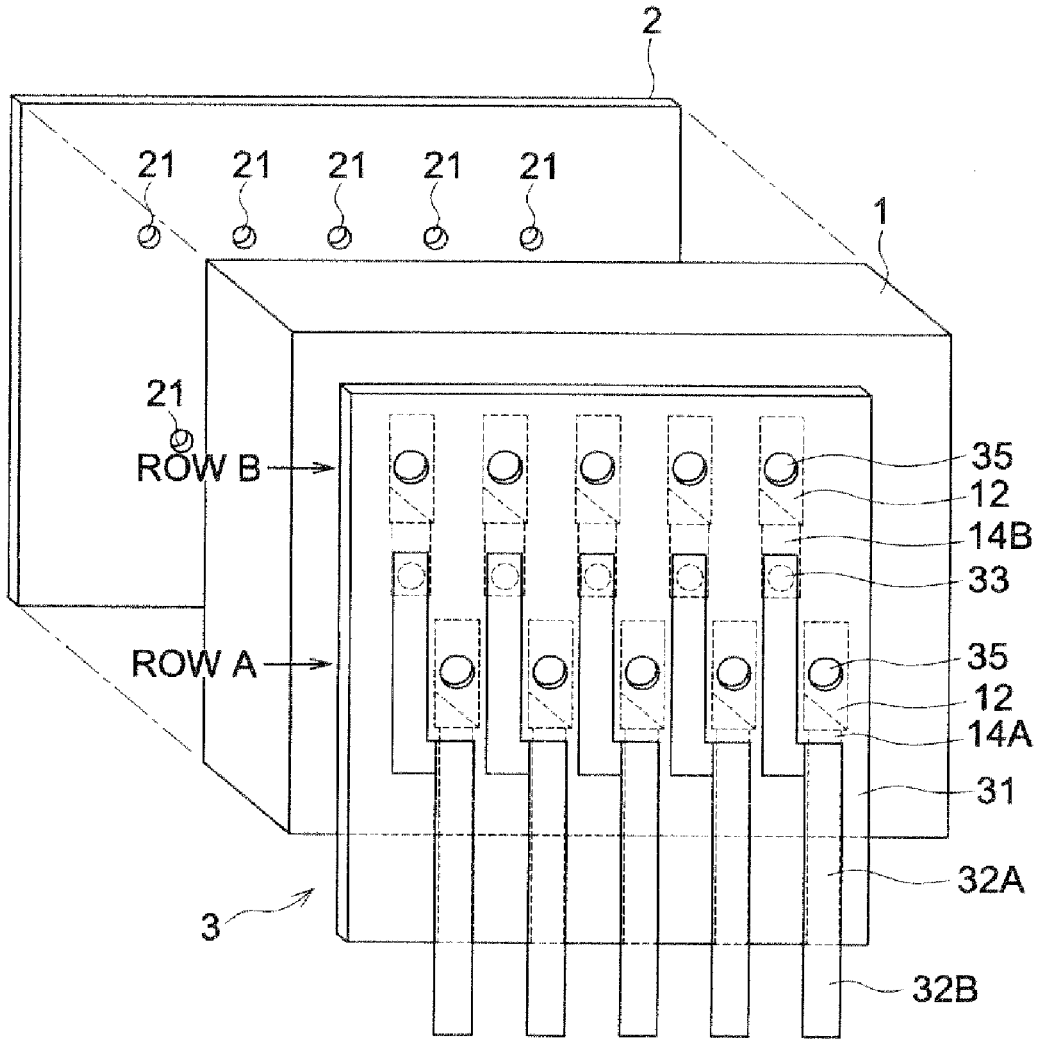
FIG. 12 is a perspective view diagram of an inkjet head according to a second preferred embodiment as seen from the side of the back surface.

FIG. 12 is a perspective view diagram of an inkjet head according to a second preferred embodiment as seen from the side of the back surface. Since the same symbols as in FIG. 1 indicate the same structure, their detailed explanations are omitted.

In this second preferred embodiment, the multilayer member 3 has not been separated into individual units but has been joined to the back surface of the head chip 1 in the form of a single large shape that covers all the channels 12 of the head chip except that only the lead wirings 32B for row B have been separated individually and are also exposed on the side of the same surface as the surface of joining with the head chip 1 at the part connecting with the FPC that protrudes outwards by a large distance beyond the lower edge part of the head chip 1 in the figure.

Because of this, although all the channels 12 that open at the back surface of the head chip 1 are closed by the insulating layer 31 of the multilayer member 3, similar to the first preferred embodiment, since all the channels 12 in the head chip 1 are ejecting channels that eject ink, ink flow inlet holes 35 for making the ink flow into each channel 12 have been opened individually in each channel 12 by laser machining or etching, etc. The shapes of the ink flow inlet holes 35 are not particularly stipulated. Each channel 12 can restrict the inflow of ink into the channel using these ink flow inlet holes 35. The ink flow inlet holes 35 in this case can also function as flow path restricting holes that restrict the flow path of ink to the channels 12.

According to this second preferred embodiment, in addition to the effects similar to those of the first preferred embodiment, there is the advantage that, using the insulating layer 31 of the multilayer member 3, it is possible to easily form the flow path restricting holes that restrict the inflow of ink into each of the channels 12.

Further, since the shape is such that the part between the edge parts (connection parts 32A') neighboring each of the lead wirings 32A that are drawn out so that they protrude towards the outside beyond the edge part of the head chip 1 are supported by the insulating layer 31, it is possible to maintain the pitch of the neighboring connection parts 32A', and it is possible to increase the ease of operation of connecting with the FPC.

Third Preferred Embodiment

Figure 13:
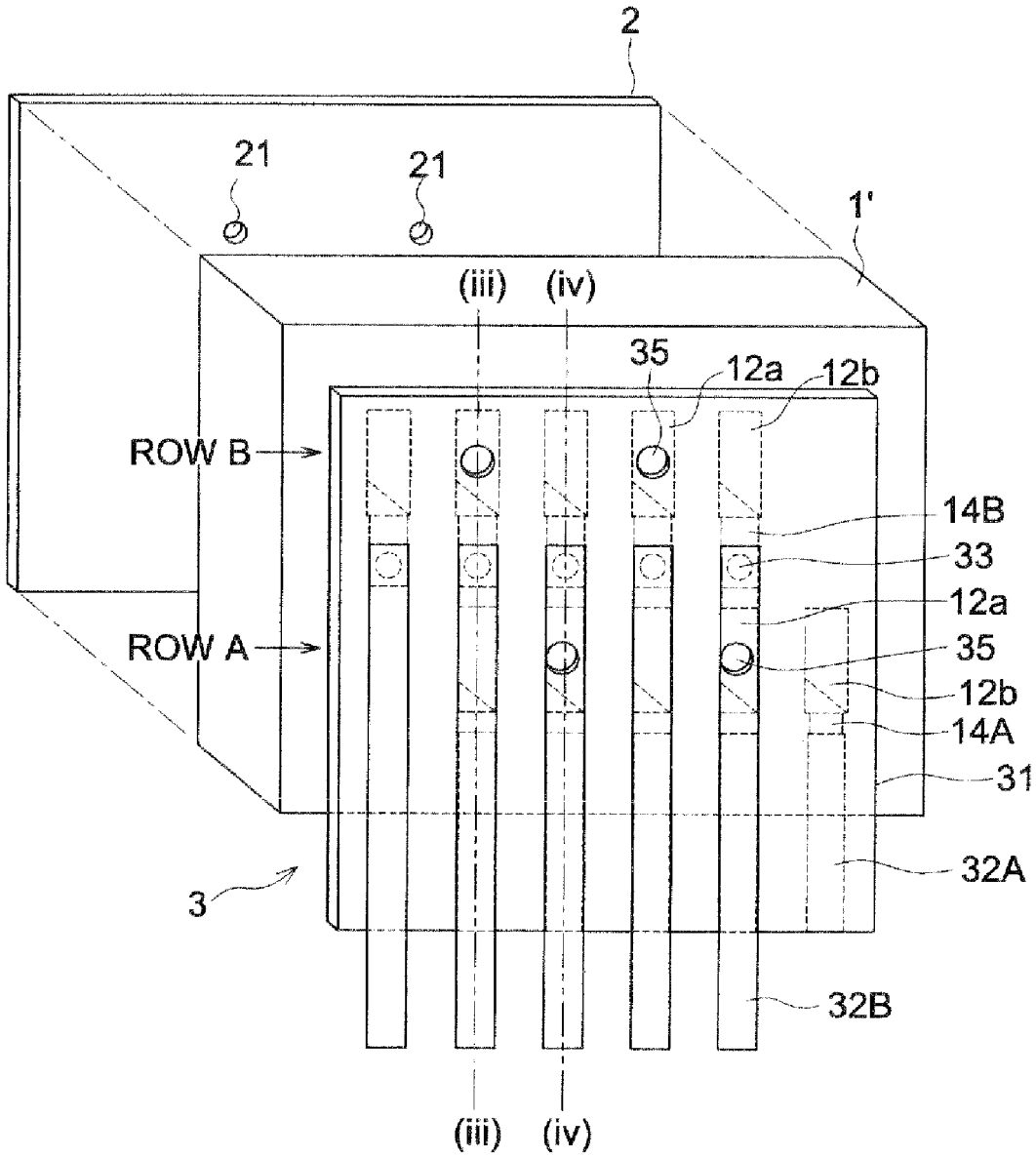
FIG. 13 is a perspective view diagram of an inkjet head according to a third preferred embodiment as seen from the side of the back surface.
Figure 14B:
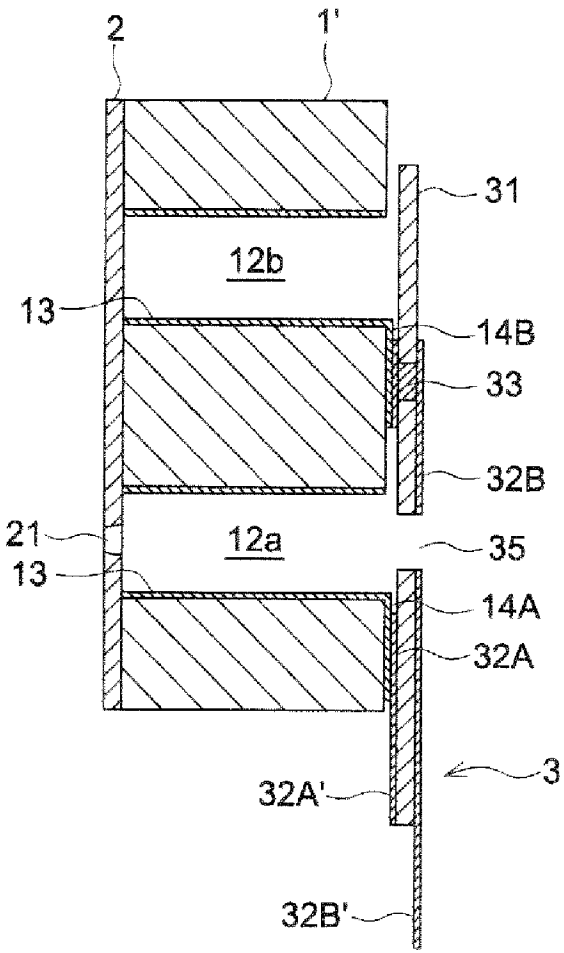
FIG. 14*b* is a cross sectional view diagram at (iv)-(iv) of FIG. 13.
Figure 14A:
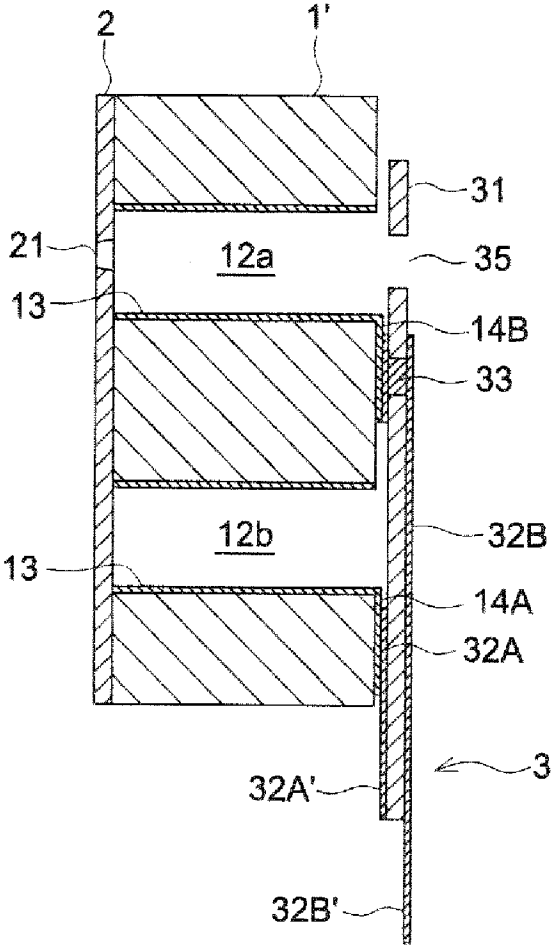
FIG. 14*a* is a cross sectional view diagram at (iii)-(iii) of FIG. 13.

FIG. 13 is a perspective view diagram of an inkjet head according to a third preferred embodiment as seen from the side of the back surface, FIG. 14*a* is a cross sectional view diagram at (iii)-(iii) of FIG. 13, and FIG. 14*b* is a cross sectional view diagram at (iv)-(iv) of FIG. 13. Further, the adhesive material layer has not been shown in the cross sectional view diagrams. In addition, since the same symbols as in FIG. 1 indicate the same structure, their detailed explanations are omitted.

The head chip 1' according to this third preferred embodiment is one in which the channels making up each of the channel rows of row A and row B are made of ejecting channels 12*a* that eject ink and air channels 12*b* that do not eject ink are alternately arranged.

In each of the channel rows of row A and row B in this head chip 1', the ejecting channels 12*a* and the air channels 12*b* are arranged so that they are shifted by one pitch from each other. In other words, when the head chip 1' is viewed in the up/down direction in the figure, the relationship is such that the ejecting channels 12*a* of row A and the ejecting channels 12*a* of row B and the air channels 12*b* of row A and the air channels 12*b* of row B are not in one line but the ejecting channels 12*a* of row A and the air channels 12*b* of row B and the ejecting channels 12*a* or row B and the air channels 12*b* of row A are in one line.

Even in this third preferred embodiment the multilayer member 3 has not been separated into individual units but has been joined to the back surface of the head chip 1' in the form of a single large shape except that only the lead wirings 32B for row B have been separated individually and are also exposed on the side of the same surface as the surface joined with the head chip 1 at the connection part that protrudes outwards by a large distance beyond the lower edge part of the head chip 1' in the figure.

Further, the lead wiring 32B for row B extends from the position corresponding to the connection electrode 14B for row B of the head chip 1', passes through the opening part of the ejecting channel 12*a* of row A or of the air channel 12*b*, and protrudes by a large distance outwards beyond the edge part on the row A side in the lower part of the figure.

Because of this, although all the channels that are open at the back surface of the head chip 1' (the ejecting channels 12*a* and the air channels 12*b*) are closed either by the insulating layer 31 of the multilayer member 3 or by that insulating layer 31 and the lead wiring 32B for row B, only at the positions corresponding to the ejecting channels 12*a*, ink inflow holes 35 have been opened individually by laser machining, etching, etc. By making the ink inflow holes 35 that are formed so as to penetrate through the lead wirings 32B for row B have smaller diameters than the widths of those lead wirings 32B for row B, the electrical conductivity between the lead wirings 32B for row B and the connection electrodes 14B for row B is being ensured.

According to the present third preferred embodiment, in addition to the effects similar to those of the first preferred embodiment, there are the advantages that, using the insulating layer 31 of the multilayer member 3, not only is it possible to easily form the ink inflow holes 35 that can function as flow path restricting holes, but also, it is possible to easily close the air channels 12*b* that do not require the inflow of ink.

Further, since the shape is such that the part between the edge parts (connection parts 32A') neighboring each of the lead wirings 32A that are drawn out so that they protrude towards the outside beyond the edge part of the head chip 1' are supported by the insulating layer 31, it is possible to maintain the pitch of the neighboring connection parts 32A', and it is possible to increase the ease of operation of connecting with an FPC.

Further, even in this third preferred embodiment, similar to the first preferred embodiment, by carrying out dry etching after bonding the multilayer member 3 to the back surface of the head chip 1', it is also possible to separate the multilayer member 3 into individual units by removing the unnecessary insulating layer 31 and using the lead wirings 32B for row B as the mask. However, in this case, it is necessary to close each of the ejecting channels 12*a* and the air channels 12*b* of row B using an appropriate closing material such as for example an organic film similar to the insulating layer 31, and to open ink inflow holes 35 for the ejecting channels 12*a* similar to row A.

Fourth Preferred Embodiment

Figure 15:
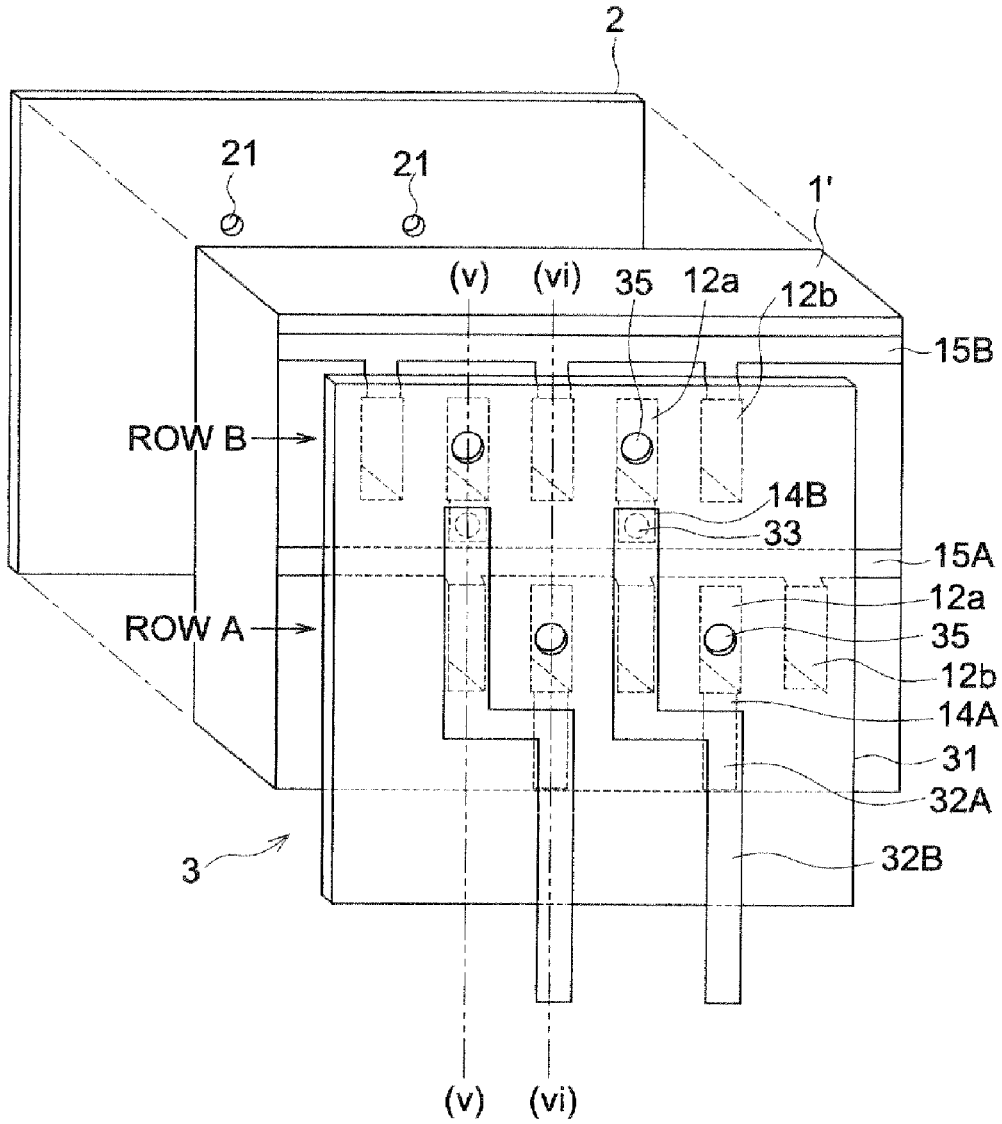
FIG. 15 is a perspective view diagram of an inkjet head according to a fourth preferred embodiment as seen from the side of the back surface.
Figure 16B:
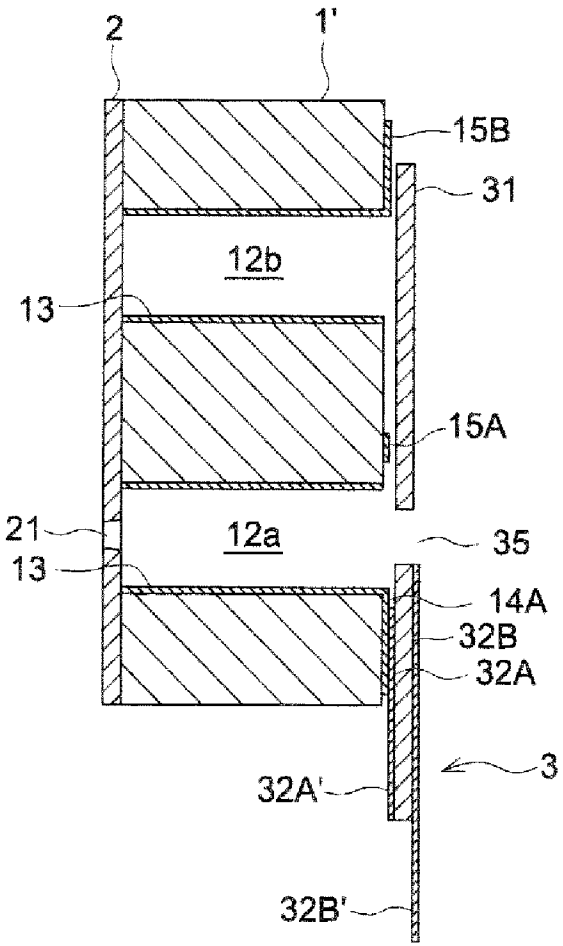
FIG. 16*b* is a cross sectional view diagram at (vi)-(vi) of FIG. 15.
Figure 16A:
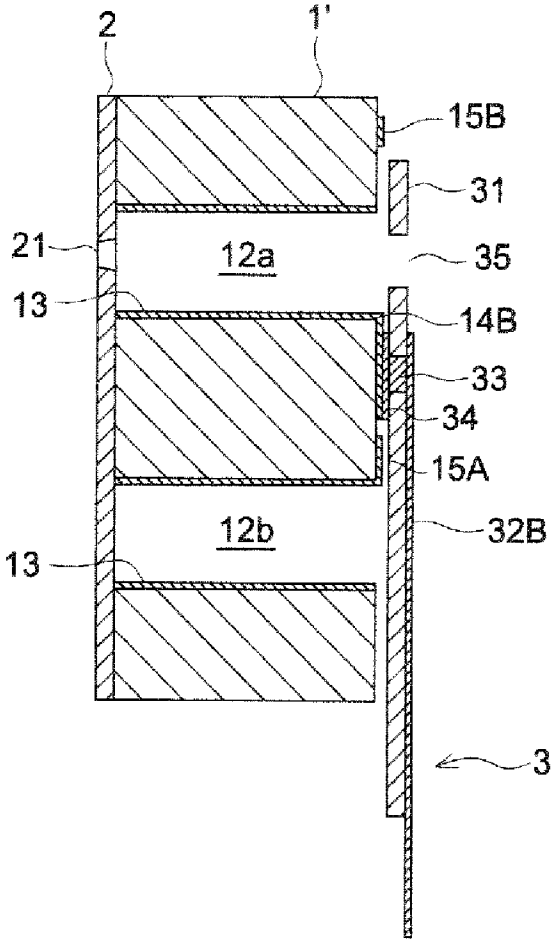
FIG. 16*a* is a cross sectional view diagram at (v)-(v) of FIG. 15.

FIG. 15 is a perspective view diagram of an inkjet head according to a fourth preferred embodiment as seen from the side of the back surface, FIG. 16*a* is a cross sectional view diagram at (v)-(v) of FIG. 13, and FIG. 16*b* is a cross sectional view diagram at (vi)-(vi) of FIG. 15. Further, the adhesive material layer has not been shown in the cross sectional view diagrams. In addition, since the same symbols as in FIG. 1 indicate the same structure, their detailed explanations are omitted.

The head chip 1' according to this fourth preferred embodiment, similar to the third preferred embodiment, is one in which the channels making up each of the channel rows of row A and row B are made of ejecting channels 12*a* that eject ink and air channels 12*b* that do not eject ink are alternately arranged.

In each ejecting channel 12*a* of row A and row B, although the connection electrodes 14A for row A and connection electrodes 14B for row B are formed respectively, the drive electrodes inside the air channels 12*b* are electrically connected to a common electrodes 15A and 15B for each row of channels. In other words, the common electrode 15A of row A is electrically connected to the drive electrodes within each of the air channels 12*b* of row A, and extends along the channel row between that row and the channels of row B. On the other hand, the common electrode 15B of row B is electrically connected to the drive electrodes within each of the air channels 12*b* of row B, and extends along the channel row on the side opposite to the side on which the row A of channels is present.

Even in this fourth preferred embodiment, the multilayer member 3 has not been separated into individual units but has been joined to the back surface of the head chip 1' in the form of a single large shape except that only the lead wirings 32B for row B have been separated individually and are also exposed on the side of the same surface as the surface of joining with the head chip 1' at the connection part that protrudes outwards by a large distance beyond the lower edge part of the head chip 1' in the figure.

Further, a lead wiring 32B for row B, is passed through the opening part of the air channels 12*b* of row A from the position corresponding to the interconnection electrode 14B for row B of the head chip 1', bent towards the neighboring ejecting channel 12*a* of row A, bent again at a position corresponding to the interconnection electrode 14A for row A, and is formed in the shape of a crank similar to the lead wiring 32B for channel B of the first preferred embodiment, and protrudes by a large distance towards the outside beyond the edge part on the side of row A in the lower part in the figure so as to overlap the lead wiring 32A for row A.

Because of this, although all the channels that are open at the back surface of the head chip 1' (the ejecting channels 12*a* and the air channels 12*b*) are closed either by the insulating layer 31 of the multilayer member 3 or by the insulating layer 31 and the lead wiring 32B for row B, only at the positions corresponding to the ejecting channels 12*a*, ink inflow holes 35 have been opened individually by laser machining, etching, etc.

According to the present fourth preferred embodiment, even in the condition in which the drive electrodes inside the air channels are connected electrically to the common electrodes 15A and 15B, in addition to the effects similar to those of the first preferred embodiment, there are the advantages that, using the insulating layer 31 of the multilayer member 3, not only it is possible to easily form the ink inflow holes 35 that can function as flow path restricting holes, but also, it is possible to easily close the air channels 12*b* that do not require the inflow of ink.

Further, since the shape is such that the part between the edge parts (connection parts 32A') neighboring each of the lead wirings 32A that are drawn out so that they protrude towards the outside beyond the edge part of the head chip 1' are supported by the insulating layer 31, it is possible to increase the ease of operation of connecting with an FPC.

Further, even in the present preferred embodiment, similar to the first preferred embodiment, by carrying out dry etching after bonding the multilayer member 3 to the back surface of the head chip 1', it is also possible to separate the multilayer member 3 into individual units by removing the unnecessary insulating layer 31 using the lead wirings 32B for row B as the mask. However, in this case, it is necessary to close each of the ejecting channels 12*a* and the air channels 12*b* of row B using an appropriate closing material such as for example an organic film similar to the insulating layer 31.

Fifth Preferred Embodiment

Figure 17:
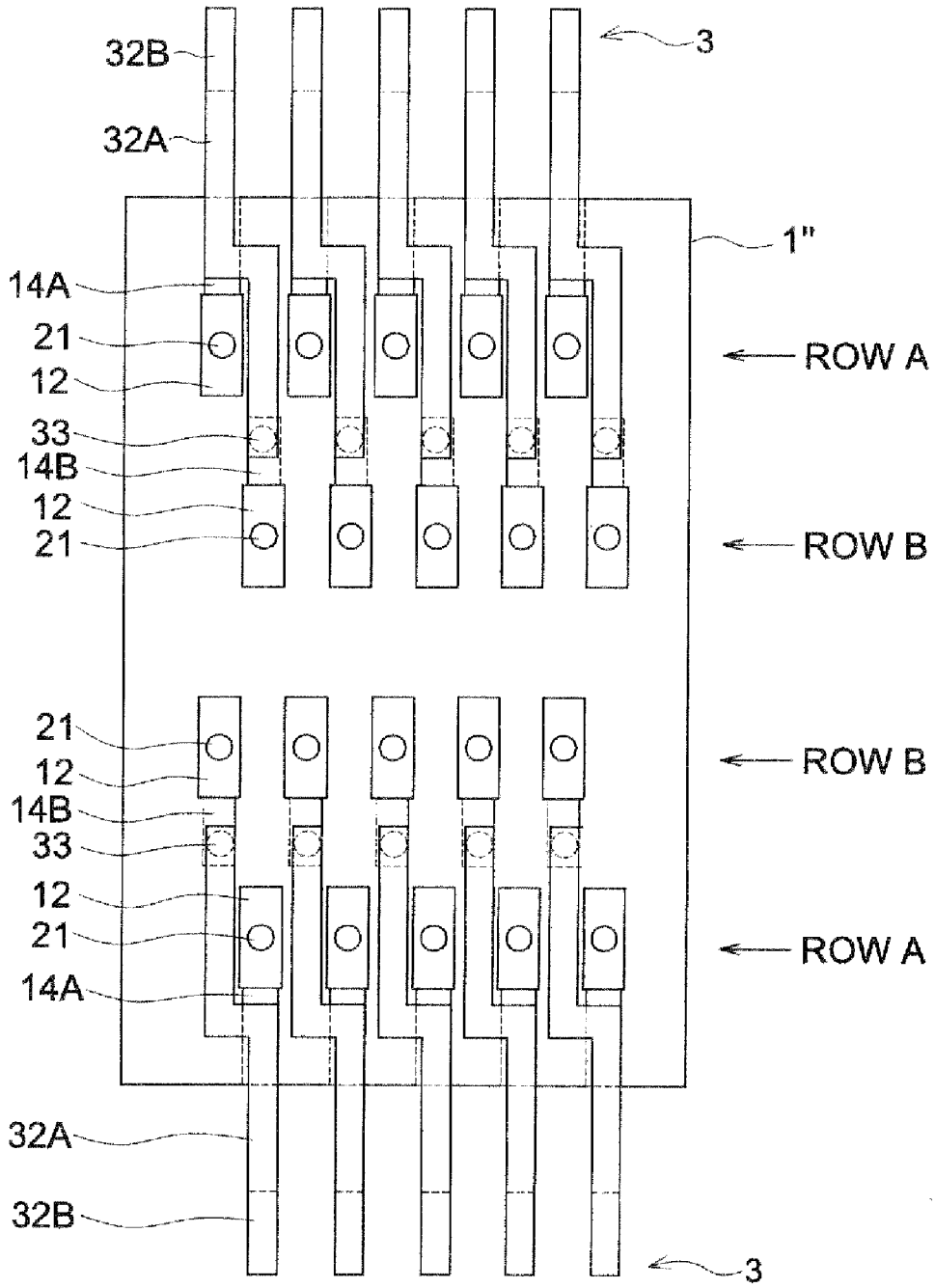
FIG. 17 is a rear view diagram of an inkjet head according to a fifth preferred embodiment.

FIG. 17 is a rear view diagram of an inkjet head according to a fifth preferred embodiment. Since the same symbols as in FIG. 1 indicate the same structure, their detailed explanations are omitted.

The head chip 1" of an inkjet head according to the present fifth preferred embodiment is a form in which there are four rows of the channel rows of the inkjet head of the first preferred embodiment. In the case of four rows of channels, the two rows of channels on the outside respectively become rows A, and the two rows of channels on the inside being enclosed by these two rows A become rows B respectively, and the multilayer member 3 is drawn outwards by a large distance so that it protrudes beyond the top and bottom edge parts of the head chip 1".

Therefore, the electrical connection to the drive interconnections for applying the drive voltages from the drive circuits to the drive electrodes inside each channel can be carried out respectively at the top and bottom edge parts of the head chip 1", and even in the case of a head chip having four rows of channels, it is possible to easily carry out the electrical connection with the drive circuits at only one side on the same surface as the surface which is joined to the head chip.

Further, it is possible to have an inkjet head structure having four rows of channels in a similar manner even for the second, third, and fourth preferred embodiments.

Although explanations were given for the shear mode type inkjet head in which ink inside a channel 12 is ejected out by causing shear deformation of the drive wall 11 in each of the above preferred embodiments, the present inventions shall not be limited to shear deformation of the drive wall 11.

According to the embodiments of the present invention, it is possible to provide an inkjet head in which, for each of the channels in neighboring two rows of channels in a harmonica type head chip in which a plurality of rows of channels are provided, the electrical connection from the drive circuits to the drive interconnections for applying the drive voltages can be easily made at only one edge part of the head chip and also on the side of the same surface as the surface which is joined with the head chip.

In particular, even in the case of an inkjet head having four rows of channels, it is possible to simplify the operations at the time of making electrical connections, and it is possible to provide a high resolution and high speed inkjet head.

What is claimed is:

1. An inkjet head comprising:

a head chip comprising:

a plurality of rows of channels arranged in parallel to each other, wherein each row of the plurality of rows of channels comprises a plurality of channels arranged in parallel to each other, and each of the plurality of channels is provided with an opening on a front surface of the head chip, from which side ink is ejected from the head chip, and an opening on a back surface of the head chip opposite to the front surface;

a plurality of driving walls each made of piezoelectric member, wherein each of the plurality of driving walls and each of the plurality of channels are provided alternately; and a plurality of drive electrodes provided in each of the plurality of channels;

wherein, when assuming that one of the plurality of rows of channels provided on a side of an end of the head chip is row A and another of the plurality of rows of channels provided next to row A is row B, on the back surface of the head chip, a plurality of interconnection electrodes for row A that conduct electrically to the plurality of drive electrodes are formed extending from each of the plurality of channels of row A to the end of the head chip and a plurality of interconnection electrodes for row B that conduct electrically to the plurality of drive electrodes are formed extending from each of the plurality of channels of row B to short of the row A;

a nozzle plate comprising a plurality of nozzles;

a multi layer member comprising:

an insulating layer;

a lead wiring for row A provided on one surface of the insulating layer; and a lead wiring for row B provided on the other surface of the insulating layer;

wherein the one surface of the insulating layer faces the back surface of the head chip, the lead wiring for row A is connected so as to conduct electrically to one of the plurality of interconnection electrodes for row A and the lead wiring for row B is connected so as to conduct electrically to the one of the plurality of interconnection electrodes for row B;

wherein an end portion of the multilayer member protrudes beyond the end of the head chip on the row A side of the head chip; and wherein, at an end portion of the multilayer member, the lead wiring for row B extends beyond an end portion of the insulating layer over the lead wiring for row A outward; and a plurality of drive interconnections for applying drive signals from a drive circuit to the lead wiring for row A and the lead wiring for row B from a side of a surface of joining the multilayer member with the head chip.

2. The inkjet head of claim 1, wherein the plurality of rows of channels is four rows, two rows provided on both sides of both ends of the head chip among the four rows are determined to rows A and two rows provided on the inner side among the four rows are determined to rows B.

3. The inkjet head of claim 1, wherein in a region where the lead wiring for row B overlaps the interconnection electrode for row B, a penetrating electrode is formed that penetrates through the insulating layer and electrical connection becomes possible between the lead wiring for row B and interconnection electrode for row B.

4. The inkjet head of claim 1, wherein the lead wiring for row A and the lead wiring for row B are formed so that they overlap each other at the same position on both surfaces of the insulating layer, and wherein the lead wiring for row A corresponds to the interconnection electrode for row A at the position.

5. The inkjet head of claim 1, wherein the insulating layer is made of an organic film that can be patterned by dry etching.

6. The inkjet head of claim 1, wherein all the channels of the plurality of channels are ejecting channels that eject ink, wherein the multilayer member is in a size that can cover all of the channels in the row A and row B on the back surface of the head chip, and wherein ink flow inlet holes for making the ink flow into each channel are provided at each position corresponding to each channel.

7. The inkjet head of claim 1, wherein the plurality of channels comprises ejecting channels that eject ink and air channels that do not eject ink and the ejecting channel and the air channel are alternately arranged, wherein the multilayer member is in a size that can cover all of the channels in the row A and row B on the back surface of the head chip, and wherein ink flow inlet holes for making the ink flow into each channel are provided only at positions corresponding to each of the ejecting channels.

* * * * *